US009263832B2

(12) United States Patent
Wang et al.

(10) Patent No.: US 9,263,832 B2
(45) Date of Patent: Feb. 16, 2016

(54) MALE CONNECTOR AND ELECTRONIC DEVICE WITH ELECTROSTATIC DISCHARGE FUNCTION

(71) Applicant: HON HAI PRECISION INDUSTRY CO., LTD., New Taipei (TW)

(72) Inventors: Chih-Ching Wang, New Taipei (TW); Yu-Hua Ho, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 247 days.

(21) Appl. No.: 13/965,228

(22) Filed: Aug. 13, 2013

(65) Prior Publication Data

US 2014/0051268 A1 Feb. 20, 2014

(51) Int. Cl.

*H01R 13/648* (2006.01)
*H01R 12/50* (2011.01)
*H01R 24/62* (2011.01)

(52) U.S. Cl.

CPC ..... *H01R 13/6485* (2013.01); *H01R 23/68* (2013.01); *H01R 24/62* (2013.01)

(58) Field of Classification Search

CPC ..... H01R 23/68; H01R 13/6485; H01R 24/62
USPC ..... 439/55, 181
See application file for complete search history.

(56) References Cited

U.S. PATENT DOCUMENTS

| | | | | |
|---|---|---|---|---|
| 4,889,497 | A * | 12/1989 | Riches | 439/620.08 |
| 6,200,162 | B1 * | 3/2001 | Aoyama et al. | 439/578 |
| 6,896,527 | B1 * | 5/2005 | Peng | 439/607.01 |
| 7,252,518 | B1 * | 8/2007 | Ni | 439/607.01 |
| 7,614,920 | B1 * | 11/2009 | Yi | 439/682 |
| 7,708,566 | B2 * | 5/2010 | Sabo et al. | 439/181 |
| 8,303,343 | B2 * | 11/2012 | Nagata | 439/607.54 |
| 8,894,441 | B2 * | 11/2014 | Wu et al. | 439/607.01 |
| 2010/0227504 | A1 * | 9/2010 | Wang et al. | 439/607.41 |
| 2012/0302077 | A1 * | 11/2012 | Wu | 439/135 |
| 2013/0115821 | A1 * | 5/2013 | Golko et al. | 439/638 |

* cited by examiner

*Primary Examiner* — Briggitte R Hammond
(74) *Attorney, Agent, or Firm* — Novak Druce Connolly Bove + Quigg LLP

(57) ABSTRACT

A male connector having an electrostatic discharge (ESD) function includes a metal portion, an insulating portion and a cable. The metal portion is inserted into a female connector. One end of the insulating portion is connected to the metal portion and another end of the insulating portion is connected to the cable. The cable includes a plurality of sub-cables and a grounded metal layer. The metal layer surrounds the sub-cables, and is in electrical contact with the metal portion. Static electricity on the metal portion is conducted to ground via the metal layer.

20 Claims, 5 Drawing Sheets

MALE CONNECTOR AND ELECTRONIC DEVICE WITH ELECTROSTATIC DISCHARGE FUNCTION

BACKGROUND

1. Technical Field

The disclosure generally relates to a male connector, and more particularly to a male connector of a universal serial bus (USB) having an electrostatic discharge (ESD) function.

2. Description of the Related Art

A USB connector is used to connect between two electronic components, such as computers and servers, and transmits signals between the two electronic components. The USB connector includes a male connector and a female connector that are respectively connected to different electronic components. The male connector is inserted into the female connector so as to form a signal transmission channel between the two electronic components. Generally, when the male connector is inserted into the female connector, a metal shell of the male connector is generally accommodated within the female connector. However, integrity of signal transmission between the two connectors may be influenced by static electricity on the metal shell.

Therefore, there is room for improvement within the art.

BRIEF DESCRIPTION OF THE DRAWINGS

Many aspects of an exemplary connector can be better understood with reference to the following drawings. The components in the drawings are not necessarily drawn to scale, the emphasis instead being placed upon clearly illustrating the principles of the exemplary connector. Moreover, in the drawings, like reference numerals designate corresponding parts throughout the several views. Wherever possible, the same reference numbers are used throughout the drawings to refer to the same or like elements of an embodiment.

DETAILED DESCRIPTION

Reference will be made to drawings to describe various embodiments.

Figure 1:
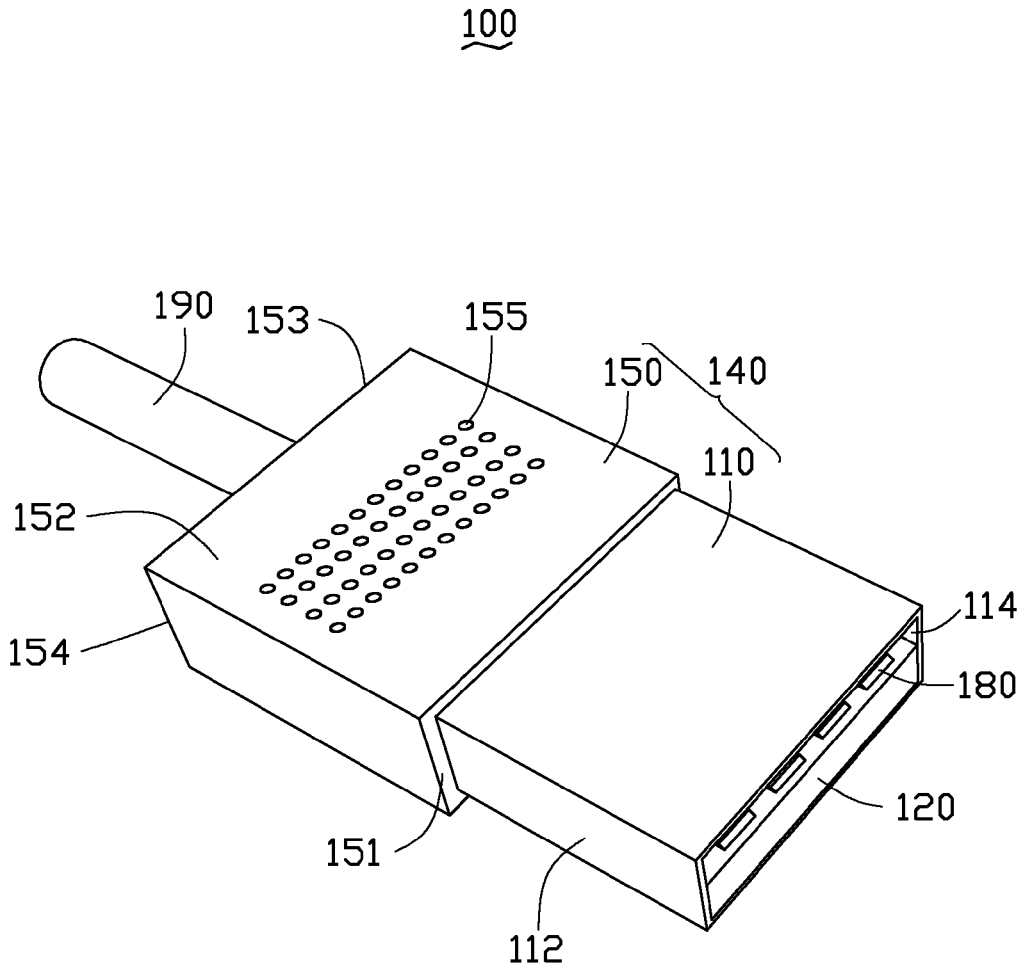
FIG. 1 is an isometric view of a male connector according to an exemplary embodiment of the present disclosure, the connector including a cable.

FIG. 1 is an isometric view of a male connector 100 according to an exemplary embodiment of the present disclosure, the connector 100 including a cable 190. The male connector 100 is insertable into a female connector (not shown) so as to form a signal transmission channel between two electronic devices. The male connector 100 includes a receiving shell 140, a supporting portion 120, a plurality of metal terminals 180 and the cable 190. The plurality of metal terminals 180 are received in the receiving shell 140 and supported by the supporting portion 120. In the embodiment, the supporting portion 120 is made of an insulating material. The cable 190 passes through an opening (not labeled) positioned at an end of the receiving shell 140. The receiving shell 140 includes a metal portion 110, as a part of the male connector 100, which is inserted into the female connector and an insulating portion 150 connecting to the metal portion 110. The metal portion 110 defines a first receiving space 114 to receive front portions of the metal terminals 180. The insulating portion 150 defines a second receiving space 154 to receive remaining portions of the metal terminals 180. The first receiving space 114 communicates with the second receiving space 154. In the embodiment, the number of the metal terminals 180 is four.

Figure 5:
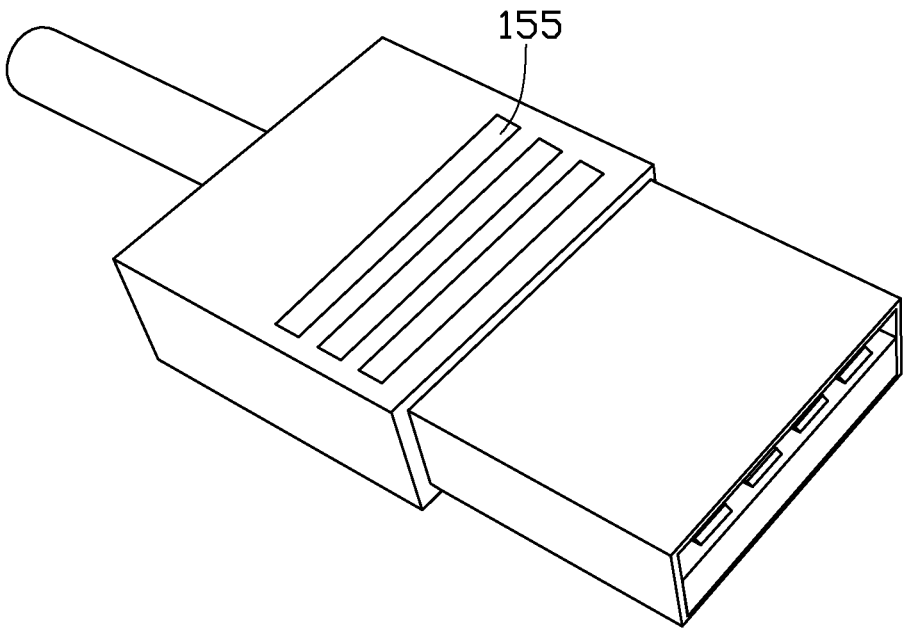
FIG. 5 is an isometric view of a connector according to another exemplary embodiment of the present disclosure.

The metal portion 110 includes a plurality of first sidewalls 112 connected end to end to define the first receiving space 114. The insulating portion 150 includes a plurality of second sidewalls 152 and a base plate 153 connected with the second sidewalls 152, the second sidewalls 152 cooperate with the base plate 153 to define the second receiving space 154. A cross-section of the insulating portion 150 is slightly greater than a cross-section of the metal portion 110, so a step is formed. The step defines a resisting surface 151 between the insulating portion 150 and the metal portion 110. When the connector 100 is inserted into the female connector, the resisting surface 151 abuts against the female connector. A plurality of through holes 155 are defined on at least one of the second sidewalls 152. The through holes 155 are arranged in a regular pattern. An area where the regular pattern is disposed is less than one half of an area of the second sidewall 152. Shape of each through hole 155 is not limited to being a circle, in another embodiment, and the through hole 155 may other shapes, such as rectangular, as shown in FIG. 5.

Figure 2:
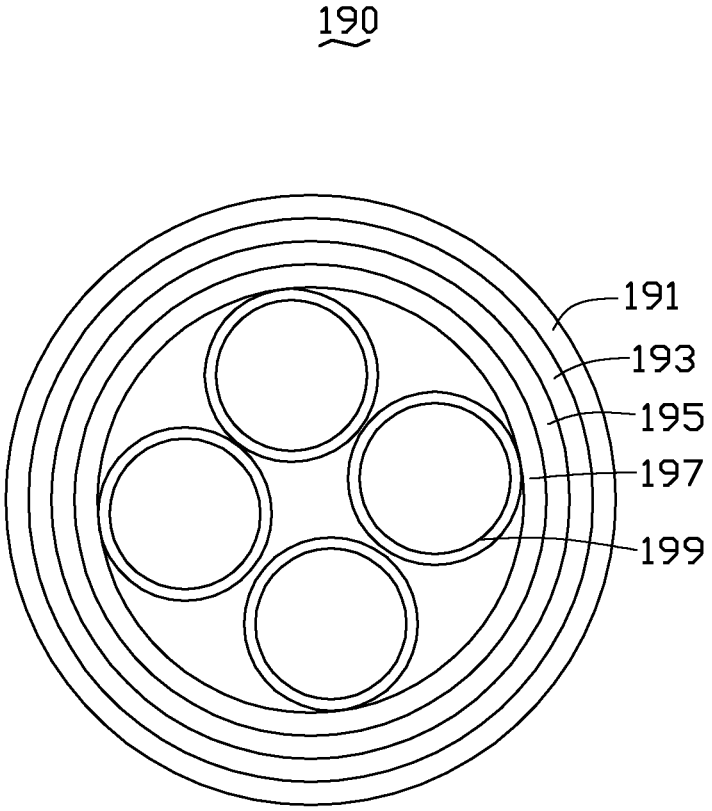
FIG. 2 is a cross-sectional view of the cable of FIG. 1.

Referring to FIG. 2, FIG. 2 is a cross-sectional view of the cable 190 of FIG. 1. The cable 190 includes a protection layer 191, a second metal layer 193, an insulating layer 195, a first metal layer 197 and a plurality of sub-cables 199. The first metal layer 197 surrounds the sub-cables 199 to electronically connect to the metal portion 110, and is connected to ground. The insulating layer 195 surrounds the first metal layer 197, the second metal layer 193 surrounds the insulating layer 195, and the protection layer 191 surrounds the second metal layer 193 serving as a protection layer of the cable 190. In the embodiment, the cable 190 includes the same number of sub-cables 199 as there are metal terminals 180.

Figure 3:
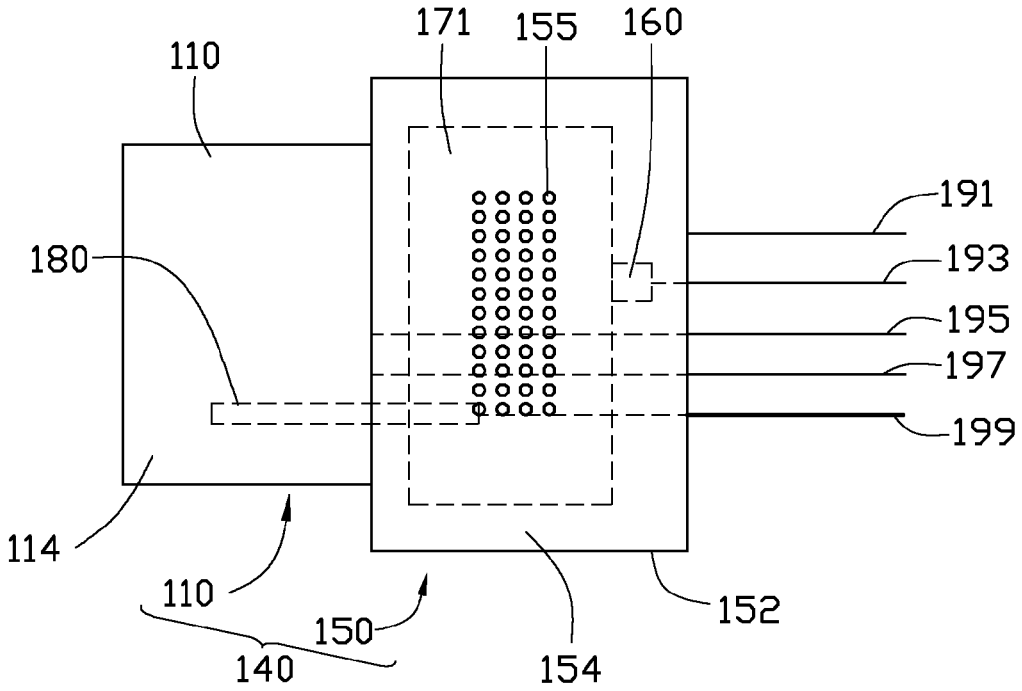
FIG. 3 is a vertical view of the male connector of FIG. 1.

Referring to FIG. 3, FIG. 3 is a vertical view of the male connector 100 of FIG. 1. The insulating portion 150 further includes a conductive plate 171 accommodated in the second receiving space 154. The conductive plate 171 is positioned inside the second receiving space 154, and corresponds to the second sidewall 152 where the through holes 155 are defined. That is, when the through holes 155 are defined on one of the second sidewalls 152, the conductive plate 171 is disposed adjacent and parallel to a second sidewall 152 which includes the through holes 155. Rear portions of the metal terminals 180 and the supporting portion 120 are received in the second receiving space 154 below the conductive plate 171. Part of the conductive plate 171 is exposed to the atmosphere via the through holes 155. The conductive plate 171 is electronically connected to the second metal layer 193 and electronically coupled to ground via the second metal layer 193. Static electricity migrates via the through holes 155 to arrive at the conductive plate 171, and then is conducted to the second metal layer 193 and to ground, so as to decrease influence of static electricity on the male connector 100 and the female connector connected thereto. Further, a resistor 160 is electronically coupled between the conductive plate 171 and the second metal layer 193 to avoid damage by static electricity to the male connector 100. In the embodiment, the conductive plate 171 is made of metal.

One of the metal terminals 180 is connected to the first metal layer 197, so as to connect the metal portion 110 to ground via the first metal layer 197. Thus, static electricity on the metal portion 110 is conducted to ground via the first metal layer 197. Signal transmission through the male connector 110 and the female connector will not be influenced by static electricity.

Figure 4:
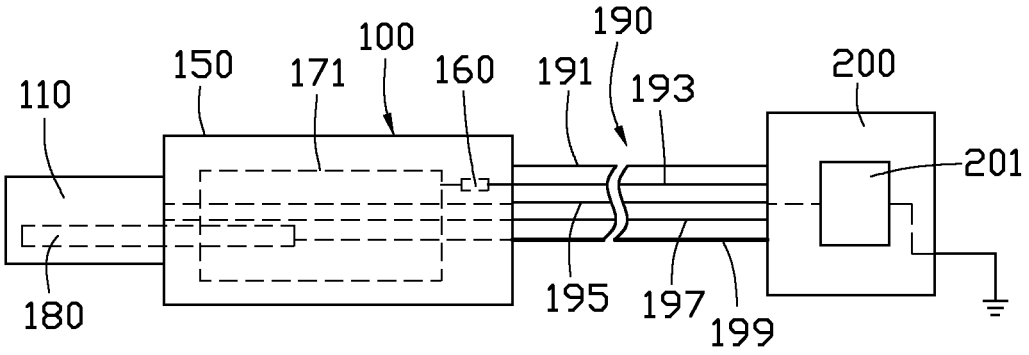
FIG. 4 is a block diagram of the connector of FIG. 1 connected to an electronic device according to an exemplary embodiment of present disclosure.

Referring to FIG. 4, FIG. 4 illustrates a block diagram when the male connector 100 connects to an electronic device 200, according to an exemplary embodiment of present disclosure. The electronic device 200 (such as a computer) includes a circuit board 201. The male connector 100 is electrically connected to the circuit board 201 via the cable 190. The circuit board 201 generates signals and drives the electronic device 200 to work. In the embodiment, the first metal layer 197 and the second metal layer 193 of the cable 190 are grounded by connection to grounding terminals located on the circuit board 201.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in the matters of shape, size, and arrangement of parts within the principles of exemplary disclosure to the full extent indicated by the broad general meaning of the terms in which the appended claims are expressed.

What is claimed is:

1. A male connector, comprising:

a metal portion insertable into a female connector; and an insulating portion connected an end of the metal portion and cooperating with the metal portion to form a receiving space for receiving a plurality of metal terminals, the insulating portion comprising a supporting member configured to support the metal terminals, the insulating portion comprising a plurality of sidewalls surrounding the receiving space;

wherein a plurality of through holes are defined on at least one of the sidewalls, at least one conductive plate is received in the receiving space and arranged adjacent to the at least one of the sidewalls corresponding to the through holes, and the at least one conductive plate is grounded.

2. The male connector according to claim 1, wherein the male connector further comprises a cable passing through an opening on an end away from the male portion; the cable comprises a plurality of sub-cables and a first metal layer; each metal terminal is electronically coupled to each sub-cable, the first metal layer surrounds the plurality of sub-cables and is grounded.

3. The male connector according to claim 2, wherein the male connector further comprises a resistor, the resistor is electronically coupled between the conductive plate and first metal layer.

4. The male connector according to claim 2, wherein the cable further comprises an insulating layer and a second metal layer; the insulating layer insulates the first metal layer and the second metal layer, the second metal layer is grounded, and the second metal layer is electronically connected to the metal portion.

5. The male connector according to claim 4, wherein the cable further comprises a protection layer, the protection layer is positioned at the external side of the cable.

6. The male connector according to claim 1, wherein the plurality of through holes are arranged in a regular pattern.

7. The male connector according to claim 1, wherein an area occupied by the through is less than half of an area of the second sidewall where the through holes are positioned on.

8. The male connector according to claim 1, wherein a cross-section of the insulating portion is greater than a cross-section of the metal portion; a resisting surface is formed between the insulating portion and the metal portion; when the male connector is inserted into the female connector, the resisting surface abuts against the female connector.

9. A male connector, comprising:

a metal portion for inserting into a female connector, the metal portion defining a first receiving space;

a plurality of metal terminals;

a cable for transmitting external signals for the metal terminals of the male connector;

a support portion configured to support the metal terminals;

an insulation portion;

wherein the insulation portion is connected an end of the metal portion and cooperating with the metal portion to form a receiving space for receiving the plurality of metal terminals and the support portion; the insulation portion comprises a plurality of sidewalls connecting end to end; the metal portion is grounded;

wherein a plurality of through holes are defined on at least one of the sidewalls, at least one conductive plate is received in the receiving space and arranged adjacent to the at least one of the sidewalls corresponding to the through holes, and the at least one conductive plate is grounded.

10. The male connector according to claim 9, wherein the cable comprises a plurality of sub-cables and a first metal layer surrounding the plurality of sub-cables, the first metal layer is grounded.

11. The male connector according to claim 10, wherein the cable further comprises an insulating layer and a second metal layer; the insulating layer insulates the first metal layer and the second metal layer, the second metal layer is grounded, the second metal layer is electronically connected with the at least one conductive plate.

12. The male connector according to claim 11, wherein the male connector further comprises at least a resistor, the resistor is electronically coupled between the conductive plate and the second metal layer.

13. An electronic device, comprising:

a circuit board;

a male connector connected with the circuit board;

wherein the male connector comprises:

a metal portion for inserting into a female connector; and an insulating portion connected an end of the metal portion and forms a receiving space cooperating with the metal portion for receiving a plurality of metal terminals and a supporting member configured to support the metal terminals, the insulating portion comprising a plurality of sidewalls surrounding the receiving space;

a plurality of through holes are defined on at least one of the sidewalls, at least one conductive plate is received in the receiving space and arranged adjacent to the at least one of the sidewalls corresponding to the through holes, and the at least one conductive plate is grounded.

14. The electronic device according to claim 13, wherein the male connector further comprises a cable passing through an opening on the end away from the male portion; the cable comprises a plurality of sub-cables and a first metal layer; each metal terminal is electronically coupled to each sub-cable, the first metal layer surrounds the plurality of sub-cables and is grounded.

15. The electronic device according to claim 14, wherein the male connector further comprises a resistor, the resistor is electronically coupled between the conductive plate and first metal layer.

16. The electronic device according to claim 14, wherein the cable further comprises an insulating layer and a second metal layer, the insulating layer insulates the first metal layer and the second metal layer, the second metal layer is grounded, and the second metal layer is electronically connected to the metal portion.

17. The electronic device according to claim 14, wherein the cable further comprises a protection layer, the protection layer is positioned at the external side of the cable.

18. The electronic device according to claim 13, wherein the plurality of through holes are arranged in a regular pattern.

19. The electronic device according to claim 13, wherein an area occupied by the through is less than a half area of the second sidewall where the through holes a positioned on.

20. The electronic device according to claim 13, wherein a cross-section of the insulating portion is greater than a cross-section of the metal portion, a resisting surface is formed between the insulating portion and the metal portion, when the male connector is inserted into the female connector, the resisting surface abuts against the female connector.

* * * * *